US007093309B2

(12) United States Patent
Kollmann et al.

(10) Patent No.: US 7,093,309 B2
(45) Date of Patent: Aug. 22, 2006

(54) SHOWER-FIXTURE HOLDER

(75) Inventors: Fabian Kollmann, Stuttgart (DE); Andreas Haug, Stuttgart (DE); Tom Schoenherr, Stuttgart (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 10/734,881

(22) Filed: Dec. 12, 2003

(65) Prior Publication Data

US 2004/0143897 A1 Jul. 29, 2004

(30) Foreign Application Priority Data

Dec. 13, 2002 (DE) ..... 102 60 206

(51) Int. Cl.
*A47K 4/00* (2006.01)

(52) U.S. Cl. ..... 4/570

(58) Field of Classification Search ..... 4/567–570
See application file for complete search history.

(56) References Cited

U.S. PATENT DOCUMENTS 2,072,345 A 3/1937 Schneider
6,550,079 B1 * 4/2003 Gransow et al. ..... 4/567
6,802,089 B1 * 10/2004 Cropelli ..... 4/570

FOREIGN PATENT DOCUMENTS

| | | |
|---|---|---|
| DE | 70 08 939 | 3/1970 |
| DE | 8506749 U1 | 6/1985 |
| DE | 85 06 749 | 3/1992 |
| DE | 1 01 09 448 | 2/2001 |
| EP | 05 04 749 | 3/1985 |
| EP | 07 03 323 | 9/1995 |
| EP | 0703323 A1 | 3/1996 |

OTHER PUBLICATIONS

Copy of European Search Report.

* cited by examiner

*Primary Examiner*—Charles E. Phillips
(74) *Attorney, Agent, or Firm*—Duane Morris LLP

(57) ABSTRACT

A wall-mounting rod for attaching a holder for a shower head having a shower hose has a groove on its front surface, into which the section of hose from the shower head emerging from the holder may be inserted. The holder also has a sort of groove, into which the hose may be inserted. A securing device that holds the hose in place in the groove in the rod is provided in the vicinity of the lower end of the rod.

12 Claims, 2 Drawing Sheets

SHOWER-FIXTURE HOLDER

Figure 1:
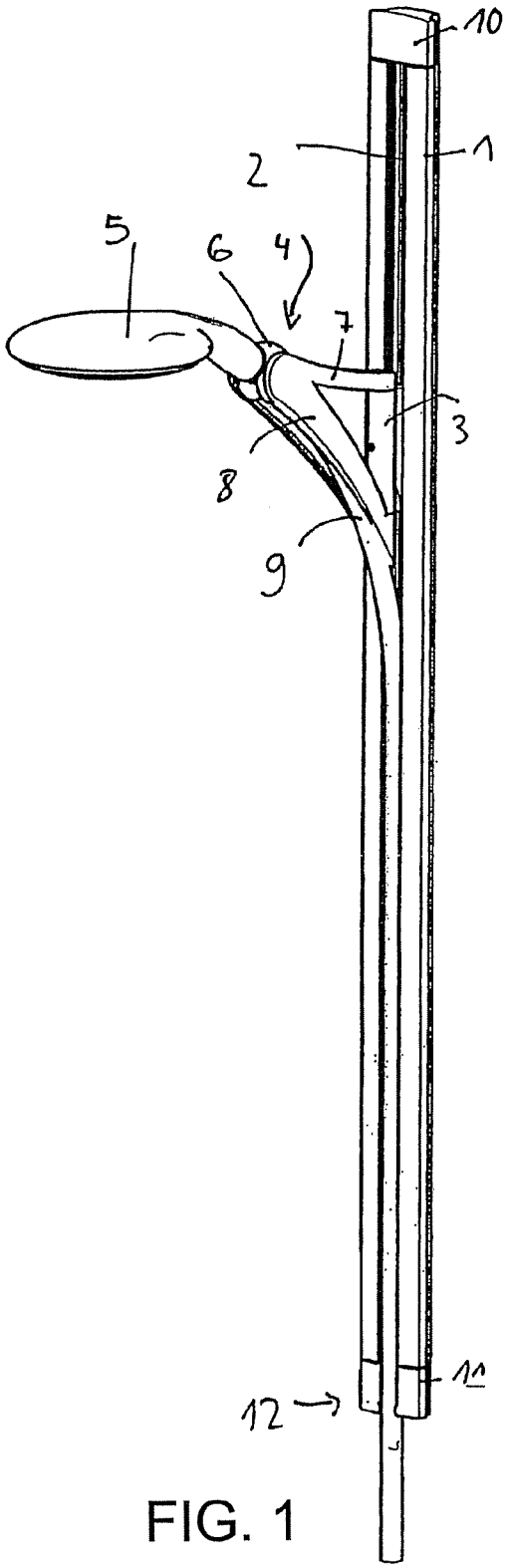

The invention is based on an arrangement for attaching a shower fixture, in particular, a shower fixture having a hose attached to its shower head.

Arrangements of this type usually have a receptacle for the shower head's grip on a shower-head holder that protrudes from their wall-mounting rod. The shower hose is attached to the tip of the grip. The shower hose thus hangs downward from the tip of the grip, i.e., hangs downward at a considerable distance from the wall-mounting rod, where it gets in the way. There is also the danger that the shower hose will become kinked near its fittings. This danger will be particularly acute whenever a user tugs on the hose or becomes entangled in it. Examples of such arrangements are known from European Patent EP 504749 and German Design Registration DE 7008939 GM.

The problem addressed by the invention is creating an arrangement where the shower hose will not get in the way and dangers of kinking due to users tugging on the hose are precluded.

In order to solve that problem, the invention proposes an arrangement having those features stated in claim 1. Elaborations on the invention are covered by the subclaims.

The invention thus provides that the shower hose is routed such that it hangs down only over a short distance, extending from the grip of the shower head, onto which it is usually screwed, and terminating just before it reaches the wall-mounting rod. It will thus be regarded as part of the wall-mounting rod and kept out of the way. Furthermore, there will no longer be any danger that careless users will become entangled in the hose, which will also preclude dangers that the hose will be come kinked in the vicinities of its fittings.

Under an elaboration, the holder and the guide for the shower hose may be designed such that the hose may be inserted and withdrawn without actuating any operating controls. For example, the hose may be pressed into a guide, where it will be held in place by a form fit or an interference fit, by exerting a slight pressure thereon. The hose will then be released from the holder under exertion of a slight force when the shower head is removed from the holder.

Under an elaboration on the invention, at least part of the guide for the shower hose may be arranged on the holder for the shower head, an option that will be available if the holder for the shower head may be slid along the wall-mounting rod using a slide.

According to the invention, it may be provided that the shower hose is routed along an arch bridging the transition from the shower head to the vertical wall-mounting rod, which may be accomplished by means of a hose conduit attached to the holder for the shower head. For example, the shower hose may be pressed into a groove having the aforementioned shape that is open at its lower end or down one side. The groove on the holder for the shower head for accommodating the shower hose may then be incorporated into the holder for the shower head, which will allow a cleaner design.

The hose holder, or, if needed, an additional hose holder, may be arranged such that it is at least partly arranged on the wall-mounting rod or forms part of the wall-mounting rod, which will also allow retaining and guiding the hose over the entire length of the wall-mounting rod.

For example, the hose guide on the wall-mounting rod may have several clips, into which the hose is inserted. These clips may, for example, also be located on the side of the wall-mounting rod. It will be particularly beneficial if the wall-mounting rod, or its cross-sectional profile, has a groove for accommodating the shower hose situated in, or on, the rod, in which case, the hose may be emplaced in the rod such that it will be nearly invisible. Such a solution will be beneficial, particularly in cases where the wall-mounting rod is configured in the form of a broad, profiled panel. The groove for accommodating the shower hose may, for example, be arranged on its side. However, this groove may also be such that it is opens out onto the front surface of the rod, and the invention prefers that this be the case. In particular, an imaginary extension of this groove is aligned on the holder for the shower head in order that the shower hose may be easily inserted into the groove therein, without need for any further kinking or bending.

According to the invention, it may be provided that the cross-section of the groove is larger than the cross-section of the hose. The hose should be merely guided by the groove, rather than clamped in place therein. The hose should also be capable of being slid upward and downward in the groove without any opposing resistance, particularly in cases where the holder for the shower head is mounted on a translatable slide.

Under an elaboration on the invention, it may be provided that the groove is undercut and the width of the slot forming the opening leading into the groove is slightly less than the diameter of the hose. A slight resistance that will provide that the hose will remain in place in the groove will then have to be overcome when inserting or withdrawing the hose.

Under a further elaboration on the invention, it may be provided that the guide for the shower hose has means of securing the hose that will inhibit withdrawal of the hose situated at at least one location on the wall-mounting rod in order to provide that the hose will actually remain in the groove, but without preventing it from being fully withdrawn therefrom. The means for securing the hose are thus designed such that withdrawal of the hose will merely be made more difficult. Nevertheless, jerking on the hose will, of course, release it from its guide.

These means for securing the hose may, for example, be beneficially arranged in the vicinity of the lower end of the wall-mounting rod. Of course, several such means of securing the hose may also be present, although the invention prefers providing only a single means of securing the hose at the lower end of the rod.

The means for securing the hose may, for example, have a deformable and/or pivotable element.

However, it will be particularly beneficial if the means for securing the hose require no moving parts. For example, the means for securing the hose may have a change in the cross-section of the groove, where that change may be either a change in its cross-sectional area or a change in the shape of its cross-section, combined with no change in its cross-sectional area.

In the case of a holder for a shower head having a translatable slide, the means for securing the hose may, in particular, be a tapering of the slot leading into the groove, which may, for example, be accomplished by providing a pair of small protrusions, one each on either edge of the slot.

According to the invention, the means for securing the hose may be arranged in a terminating element that may be attached to the lower end of the wall-mounting rod. The means for securing the hose may then be either attached to the rod or to a holder that is attached to the rod.

The invention may be applied with particularly great benefit in cases where the holder for the shower head is mounted on a slide, since the location where the shower hose is attached to the shower head will follow the motion of the slide. In this particular case, the invention provides, as an elaboration thereon, the opportunity for simultaneously utilizing a groove serving as a guide for the slide for accommodating the hose.

Figure 2:
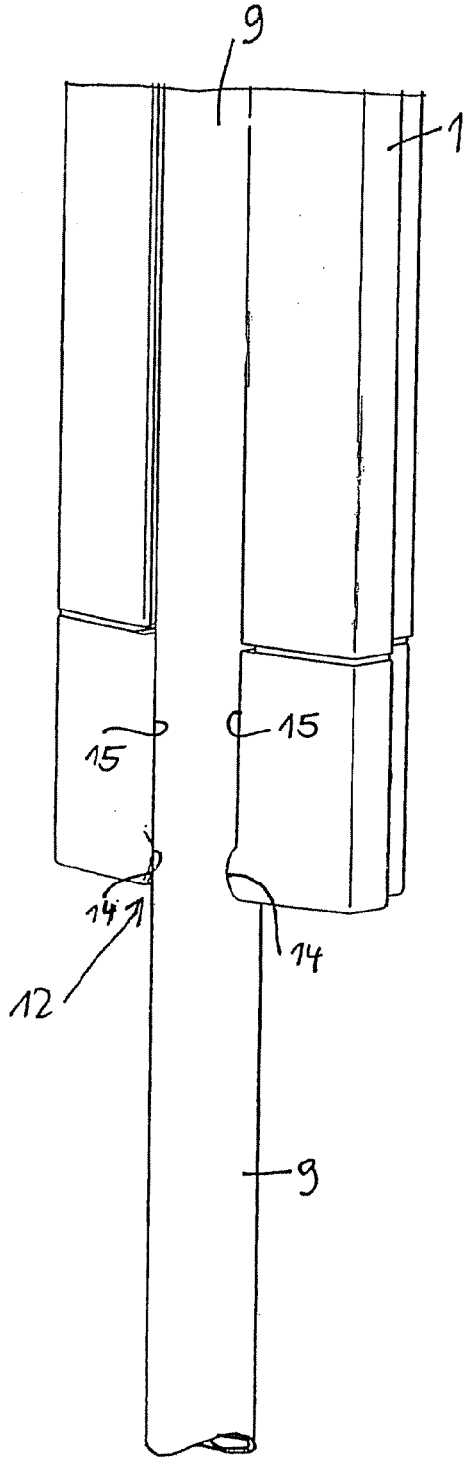
Figure 3:
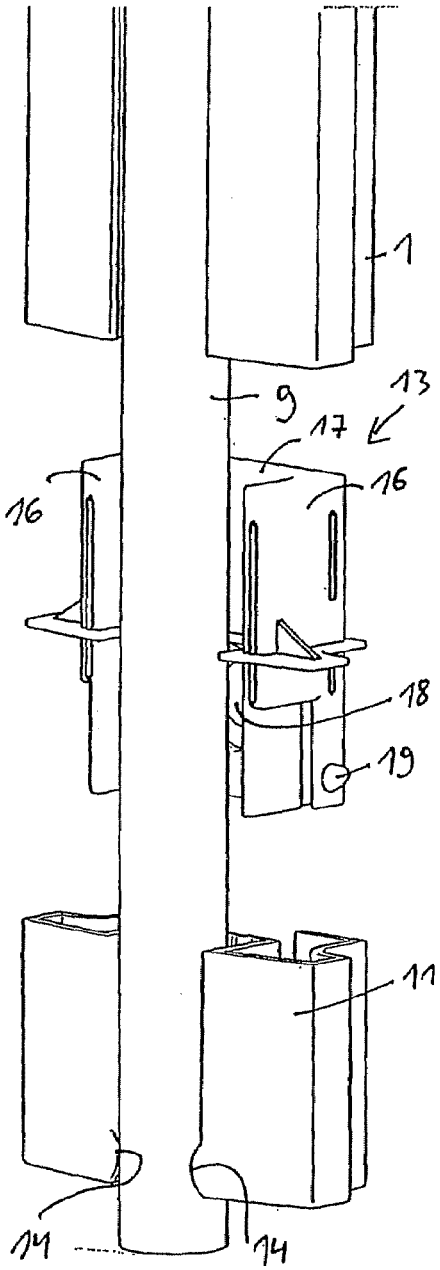
Figure 4:
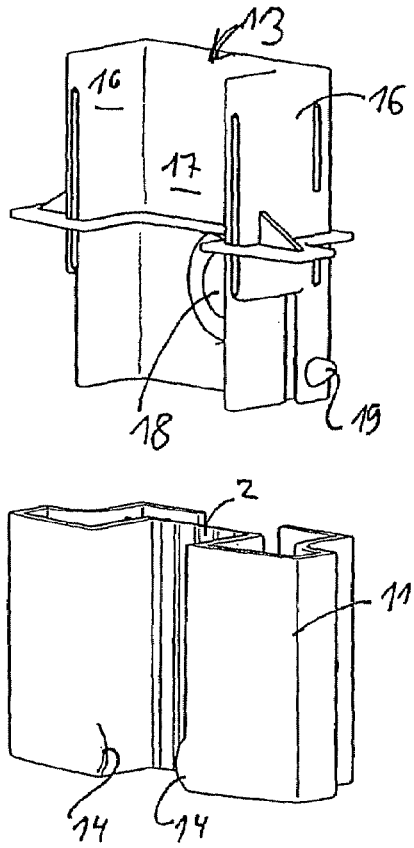

Other features, details, and benefits of the invention are as stated in the following description of a preferred embodiment of the invention, the claims, and the abstract, the wordings of both of which are herewith made part of the content of that description by way of reference thereto, and as shown in the accompanying figures. Those figures depict:

FIG. 1 a view of a shower fixture guided on a wall-mounting rod using a slide;

FIG. 2 an enlarged view of the lower end of the rod showing the hose arranged therein;

FIG. 3 an enlarged view of the components forming the lower end of the arrangement;

FIG. 4 an exploded view of the holder for attaching the rod to a wall and the terminating element to the rod.

FIG. 1 depicts an fairly common arrangement of a shower fixture utilizing a hose. A rod 1 fabricated from hollow, profiled stock is mounted on a wall. A groove 2, in which a slide 3 is guided such that it may be slid along the groove, is formed in the front surface of the rod, i.e., that surface of the rod that faces away from the wall. A holder 4 for a hand-held shower head 5 is attached to the slide 3. The holder 4 incorporates a typical conical holder 6, into which the grip of the shower head 5 is inserted. The conical holder 6 may be pivoted about a horizontal axis and is mounted between two arms 7, 8 of the holder 4 for the shower head such that it may be pivoted about them. The lower arm 8 of the holder 4 has a cavity that is open at the bottom, through with the shower hose 9 is inserted. This cavity may be slightly undercut in order that the shower hose 9 will remain in place in the cavity when it is pressed into the cavity. The hose 9 is routed along an arch bridging the transition from the holder 4 to the rod 1 in order to preclude kinking.

From the holder 4, the hose 9 proceeds into the groove 2 in the rod 1. The groove 2 is aligned on an imaginary extension of the grip of the shower head 5 such that, together, they form a straight line when viewed from the front, since the groove 2 also forms the guide-groove for the slide 3.

The rod 1 has a cap 10 on its upper end that terminates the hollow profile in the rod, including the groove 2.

A terminating element 11 that extends the groove 2 is arranged on the lower end of the rod 1. This lower terminating element 11 incorporates a securing device 12 that, although it is visible in FIG. 1, is not clearly visible therein. This securing device will be described below.

FIG. 2 depicts details of the terminating element 11 on the lower end of the rod 1 on a larger scale. The terminating element 11 continues the outer profile of the rod 1 and the profile of the groove 2 therein in unaltered forms. A holder 13 for the rod 1 and its supporting element 11 is arranged between these two elements, namely, the rod 1 and the terminating element 11. This holder 13 is depicted in the remaining figures.

Access to the groove 2 is provided by a longitudinal slot whose width is slightly less than the diameter of the groove in order that a slight undercut will be formed. However, this undercut is so slight that the hose may be easily inserted into, and withdrawn from, the groove 2. The terminating element 11 incorporates a securing device 12 in the form of a pair of protrusions 14 that extend the edge 15 of the longitudinal slot slightly inward. These protrusions are rounded over the full lengths of their perimeters in order to preclude damage to the hose 9. These protrusions 14 are shaped such that they alter neither the cross-sectional area nor the shape of the groove situated beneath the longitudinal slot. These protrusions 14, and thus the securing device 12, act only while the hose 9 is being removed from the slot. Longitudinal translations of the hose 9, which, of course, will occur whenever the holder 4 for the shower head is slid, remain unaffected in any way by the securing device 12.

FIG. 3, to which reference is now made, depicts an exploded view of the same components shown in FIG. 2. The holder 13 is configured such that it may be inserted into the lower end of the rod 1. The holder 13 is screwed onto the wall using the hole 18, through which a screw may be inserted, in the land 17 joining its pair of lateral surfaces 16.

The terminating element 11 is then inserted into the lower end of the holder 13. An elastic protrusion 19 serves to engage an opening in the side of the terminating element 11.

FIG. 4 depicts the terminating element 11 once again, but, in this case, the hose has been deleted. It may be seen that that the groove 2 in the rod 1 continues into the terminating element. In the case of the example shown, the groove has a rectangular, or square, cross-section, i.e., is hardly undercut at all. The protrusions 14 are situated in the vicinity of the outer edges of the groove, i.e., at the locations where the slot that leads into the groove 2 is formed.

The invention creates an opportunity for neatly and orderly arranging a hose 9 leading to a shower head such that it will be out of the way and will neither disrupt the shower's appearance nor restrict the space available therein.

The invention claimed is:

1. An arrangement for attaching a shower fixture, comprising:

a vertical rod to be mounted on a wall, a holder for a shower head having a fitting connection for connecting the shower head to a hose, where the holder is attached to the rod in such a manner that the fitting connection is spaced apart from the rod, a guide for the shower hose being configured such that the guide guides the shower hose from the fitting connection connecting the hose to the shower head at least to a vicinity immediately adjoining the rod, and wherein at least part of the hose guide is formed on the rod.

2. An arrangement according to claim 1, where at least part of the hose guide is arranged on the holder for the shower head.

3. An arrangement according to claim 1, where the shower hose is held in place on an arch bridging a 4 transition to the vertical rod.

4. An arrangement according to claim 1, where the hose guide has a groove for accommodating the shower hose arranged in, or on, the rod.

5. An arrangement according to claim 4, where the groove opens out onto a front surface of the rod.

6. An arrangement according to claim 4, where the groove has a cross-section that is larger than a cross section of the hose.

7. An arrangement according to claim 4, where the groove opens at a slot having a width that is slightly less than a diameter of the hose.

8. An arrangement according to claim 1, where the guide for the shower hose resists withdrawal of the hose at least at one location along the rod.

9. An arrangement according to claim 8, where the means for securing the hose comprises a change in cross-section along the groove.

10. An arrangement according to claim 8, where the means for securing the hose is arranged in a vicinity of a lower end of the rod.

11. An arrangement according to claim 4, where the holder for the shower head is mounted on a translatable slide, slidable in a guide-groove which forms the groove for accommodating the hose.

12. An arrangement for attaching a shower fixture, comprising:

a vertical rod to be mounted on a wall, a holder for a shower head having a fitting connection for connecting the shower head to a hose, where the holder is attached to the rod in such a manner that the fitting connection is spaced apart from the rod, a guide for the shower hose being configured such that the guide guides the shower hose from the fitting connection connecting the hose to the shower head at least to a vicinity immediately adjoining the rod, where the guide for the shower hose resists withdrawal of the hose at least at one location where a means for securing the hose is arranged in a terminating element that is attachable at a lower end of the rod.

* * * * *